US006520334B1

(12) United States Patent
Hoover

(10) Patent No.: US 6,520,334 B1
(45) Date of Patent: Feb. 18, 2003

(54) STORAGE CONTAINER RESEMBLING A PAGER

(76) Inventor: Dennis L. Hoover, 19204 Hobbs Ct., Lutz, FL (US) 33549

( * ) Notice: Subject to any disclaimer, the term of this patent is extended or adjusted under 35 U.S.C. 154(b) by 72 days.

(21) Appl. No.: 09/754,871

(22) Filed: Jan. 5, 2001

(51) Int. Cl.[7] ..... B65D 83/04

(52) U.S. Cl. ..... 206/534; 224/24; 206/38; 206/457; D3/218

(58) Field of Search ..... 224/679, 930, 224/240; D3/218; 206/0.8, 0.81, 38, 457, 534

(56) References Cited

U.S. PATENT DOCUMENTS

| | | | | | |
|---|---|---|---|---|---|
| 3,027,995 | A | * | 4/1962 | Littman | 206/0.81 |
| 3,092,244 | A | * | 6/1963 | McWhirter | 70/456 R |
| 3,782,584 | A | | 1/1974 | Swenson et al. | |
| D239,986 | S | * | 5/1976 | Artz | D3/226 |
| 4,775,083 | A | * | 10/1988 | Burger et al. | 224/675 |
| 4,951,817 | A | * | 8/1990 | Barletta et al. | 206/305 |
| D329,945 | S | | 10/1992 | Benskin | |
| 5,261,122 | A | * | 11/1993 | Otsuki et al. | 455/90 |
| 5,277,315 | A | * | 1/1994 | Plein | 206/270 |
| 5,312,029 | A | * | 5/1994 | Tuber | 224/679 |
| 5,379,884 | A | * | 1/1995 | Bigott | 206/37 |
| 5,598,926 | A | * | 2/1997 | Vogt | 206/457 |
| 5,642,807 | A | * | 7/1997 | Barnes | 206/38.1 |
| 5,779,122 | A | | 7/1998 | Martinelli | |
| 5,803,323 | A | * | 9/1998 | Hayashi et al. | 224/241 |
| D400,006 | S | | 10/1998 | Girvetz | |
| D409,374 | S | * | 5/1999 | Laba et al. | D3/215 |
| 5,915,558 | A | | 6/1999 | Girvetz | |
| D415,762 | S | | 10/1999 | Halstead et al. | |

* cited by examiner

*Primary Examiner*—Mickey Yu
*Assistant Examiner*—Troy Arnold

(57) ABSTRACT

A storage container resembling a pager for storing and organizing items in a discrete and disguised manner. The storage container resembling a pager includes a housing that has a front wall and a back wall. A bottom wall and a first side wall and a second side wall are coupled to and extend between the front and back walls to define a storage compartment that has an open top. A cover is pivotally coupled to the housing for selectively covering the open top. A display is mounted on the front wall of the housing and a plurality of buttons is mounted on the front wall of the housing.

12 Claims, 2 Drawing Sheets

STORAGE CONTAINER RESEMBLING A PAGER

BACKGROUND OF THE INVENTION

1. Field of the Invention

The present invention relates to storage containers and more particularly pertains to a new storage container resembling a pager for storing and organizing items in a discrete and disguised manner.

2. Description of the Prior Art

The use of storage containers is known in the prior art. More specifically, storage containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,915,558; 5,779,122; 3,782,584; U.S. Pat. No. Des. 415,762; U.S. Pat. No. Des. 329,945; and U.S. Pat. No. Des. 400,006.

While these devices fulfill their respective, particular objectives and requirements, the aforementioned patents do not disclose a new storage container resembling a pager. The inventive device includes a housing that has a front wall and a back wall. A bottom wall and a first side wall and a second side wall are coupled to and extend between the front and back walls to define a storage compartment that has an open top. A cover is pivotally coupled to the housing for selectively covering the open top. A display is mounted on the front wall of the housing and a plurality of buttons is mounted on the front wall of the housing.

In these respects, the storage container resembling a pager according to the present invention substantially departs from the conventional concepts and designs of the prior art, and in so doing provides an apparatus primarily developed for the purpose of storing and organizing items in a discrete and disguised manner.

SUMMARY OF THE INVENTION

In view of the foregoing disadvantages inherent in the known types of storage containers now present in the prior art, the present invention provides a new storage container resembling a pager construction wherein the same can be utilized for storing and organizing items in a discrete and disguised manner.

The general purpose of the present invention, which will be described subsequently in greater detail, is to provide a new storage container resembling a pager apparatus and method which has many of the advantages of the storage containers mentioned heretofore and many novel features that result in a new storage container resembling a pager which is not anticipated, rendered obvious, suggested, or even implied by any of the prior art storage containers, either alone or in any combination thereof.

To attain this, the present invention generally comprises a housing that has a front wall and a back wall. A bottom wall and a first side wall and a second side wall are coupled to and extend between the front and back walls to define a storage compartment that has an open top. A cover is pivotally coupled to the housing for selectively covering the open top. A display is mounted on the front wall of the housing and a plurality of buttons is mounted on the front wall of the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new storage container resembling a pager apparatus and method which has many of the advantages of the storage containers mentioned heretofore and many novel features that result in a new storage container resembling a pager which is not anticipated, rendered obvious, suggested, or even implied by any of the prior art storage containers, either alone or in any combination thereof.

It is another object of the present invention to provide a new storage container resembling a pager that may be easily and efficiently manufactured and marketed.

It is a further object of the present invention to provide a new storage container resembling a pager that is of a durable and reliable construction.

An even further object of the present invention is to provide a new storage container resembling a pager which is susceptible of a low cost of manufacture with regard to both materials and labor, and which accordingly is then susceptible of low prices of sale to the consuming public, thereby making such storage container resembling a pager economically available to the buying public.

Still yet another object of the present invention is to provide a new storage container resembling a pager which provides in the apparatuses and methods of the prior art some of the advantages thereof, while simultaneously overcoming some of the disadvantages normally associated therewith.

Still another object of the present invention is to provide a new storage container resembling a pager for storing and organizing items in a discrete and disguised manner.

Yet another object of the present invention is to provide a new storage container resembling a pager which includes a housing that has a front wall and a back wall. A bottom wall and a first side wall and a second side wall are coupled to and extend between the front and back walls to define a storage compartment that has an open top. A cover is pivotally coupled to the housing for selectively covering the open top. A display is mounted on the front wall of the housing and a plurality of buttons is mounted on the front wall of the housing.

Still yet another object of the present invention is to provide a new storage container resembling a pager that may have a display for displaying the time for a clock and also to provide a more realistic resemblance to a real pager.

Even still another object of the present invention is to provide a new storage container resembling a pager that disguises the container for reducing the embarrassment that is sometimes associated with items that may be stored in the present invention such as, for example, orthodontic devices, medication or even feminine products.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
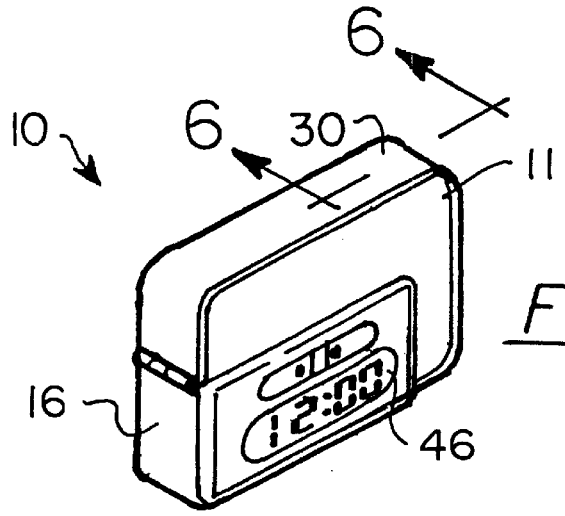
FIG. 1 is a schematic perspective view of a new storage container resembling a pager according to the present invention.

With reference now to the drawings, and in particular to FIGS. 1 through 6 thereof, a new storage container resembling a pager embodying the principles and concepts of the present invention and generally designated by the reference numeral 10 will be described.

As best illustrated in FIGS. 1 through 6, the storage container 10 generally includes a housing 11. The housing 11 includes a front wall 12 and a back wall 13. A bottom wall 14 and a first side wall 15 and a second side wall 16 are coupled to and extend between the front and back walls 12 and 13. The housing 11 defines a storage compartment 17 having an open top. A shoulder 20 is formed on the front wall 12 of the housing 11 and extends generally from the second side wall 16 toward the first side wall 15 to define a raised surface 18 between the shoulder 20 and the bottom wall 14. The housing 11 may have a length measuring approximately two and one-half inches and a height measuring approximately three inches. Additionally, the housing 11 may have a width measuring approximately one inch.

Figure 2:
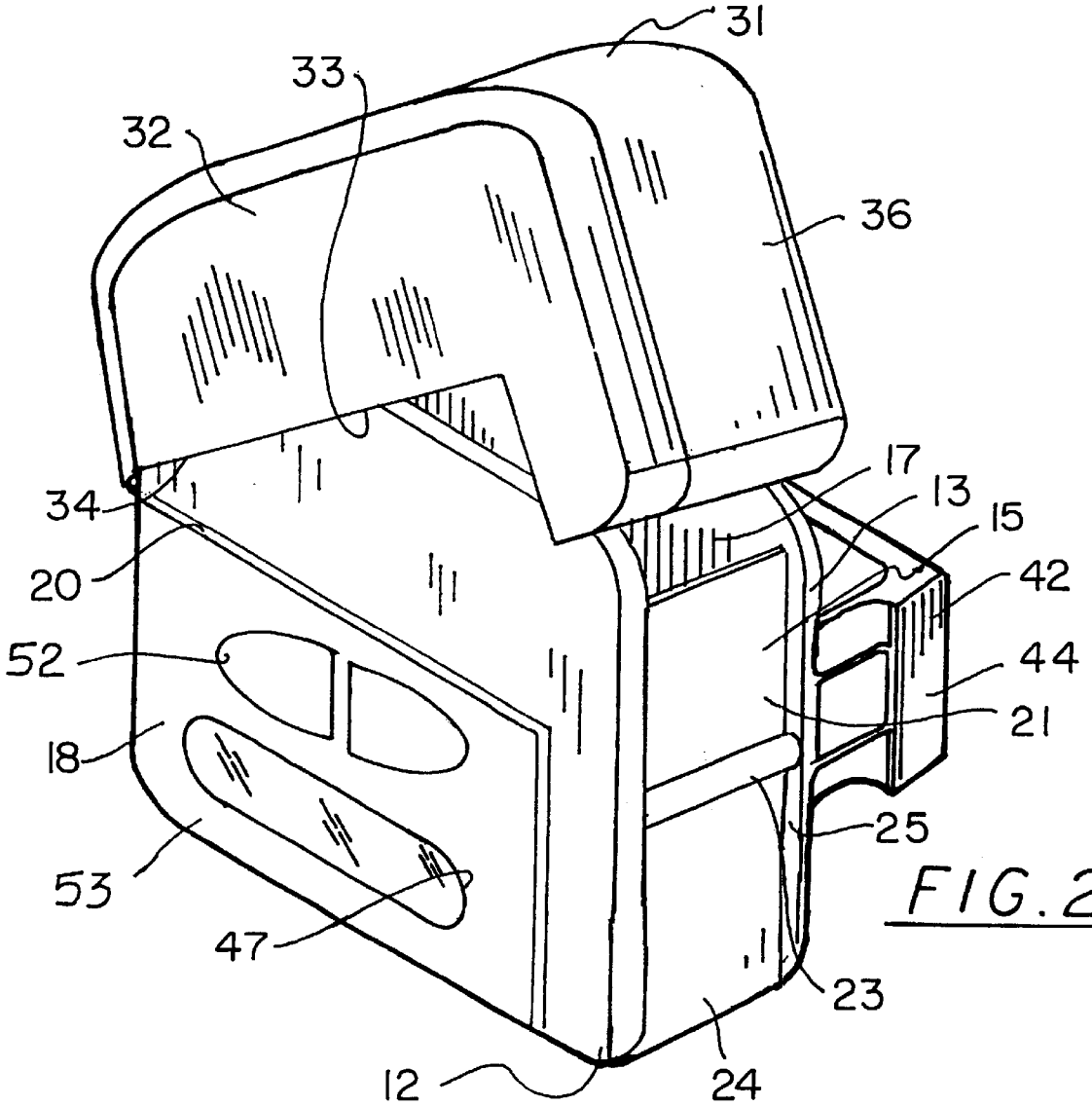
FIG. 2 is a schematic perspective view of the present invention showing a housing having a storage compartment and a cover in a partially open position.
Figure 6:
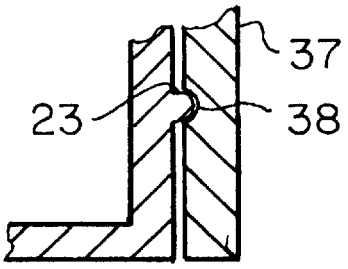
FIG. 6 is a schematic cross-sectional view of the housing and cover taken along line 6—6 of FIG. 1, showing a protruding member attached to a first side wall of the housing engage a recess extending into an inner surface of the cover.
Figure 3:
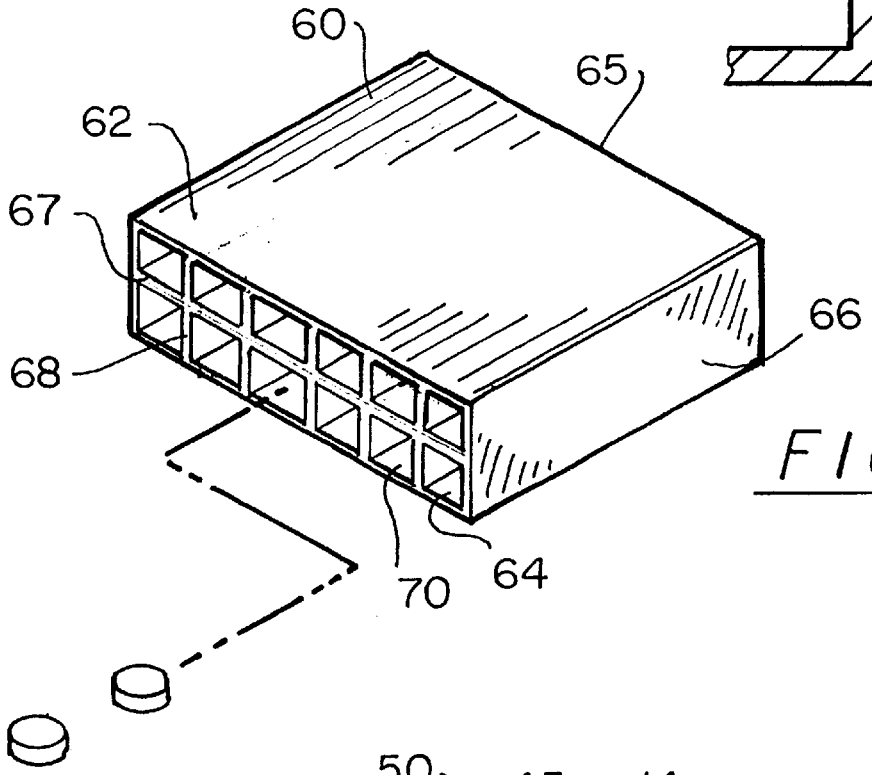
FIG. 3 is a schematic perspective view of the present invention showing a pill box insert that is removably insertable into the storage compartment of the housing.

As illustrated in FIG. 2, the front and back walls 12 and 13 extend beyond the first side wall 15 such that a channel 21 is defined. A protruding member 23 may be attached to or integrally formed with an outer surface 24 of the first side wall 12 and extending between an inner surface 25 of the front and back walls 12 and 13. The protruding member 23 is positioned generally between the open top and the bottom wall 14. The protruding member 23 may have a generally arcuate shape. The housing 11 may comprise a substantially rigid material such as, for example, a plastic that will protect the items being stored in the storage compartment 17 from crushing when inserted into a pants pocket. The housing 11 may store a variety of items such as, for example, marbles, cards, or candy (if it is being used by a child) or keys, orthodontics, or money (if it is being used by an adult).

As also illustrated by FIG. 2, a cover 30 is pivotally coupled to the housing 11 for selectively covering the open top and preventing the items stored in the storage compartment 17 from falling out. The cover 30 is movable between an open position and a closed position. The cover 30 includes a top wall 31. A peripheral wall 32 is coupled to and extends downwardly away from the top wall 31 such that a cavity 33 is defined. The front 12, back 13 and each of the side walls 15 and 16 of the housing 11 are removably positionable in the cavity 33 when the cover 30 is in the closed position.

The peripheral wall 32 includes a pair of free edges 34 orientated generally parallel to the front and back walls 12 and 13 of the housing 11. A first end 36 of the cover 30 selectively engages the front 12, back 13 and first side wall 15 of the housing 11. The first end 36 of the cover 30 includes a length extending beyond a length of the peripheral wall 32 of the cover 30. The first end 36 of the cover 30 generally has a length equal to a height of the housing 11. An inner surface 37 of the first end 36 of the cover 30 includes a recess 38 extending therein. The recess 38 is positioned generally adjacent to and extending between each of the free edges 34 of the peripheral wall 32. The recess 38 includes a size designed for releasably engaging the protruding member 23 of the first end wall 15 of the housing 11. The free edge 34 of the cover 30 selectively abuts the shoulder 20 of the front wall 12 when the cover 30 is in the closed position, thereby giving the front wall 12 of the housing 11 a flush appearance as though it was a pager housing with no openable elements.

Figure 4:
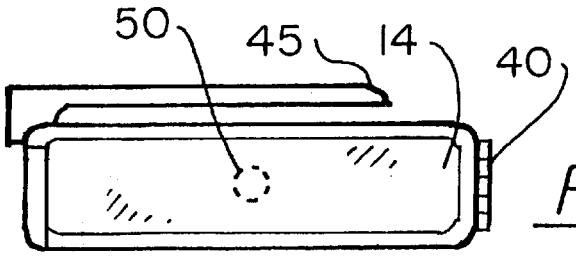
FIG. 4 is a schematic bottom view of the present invention showing a power supply being removably mounted in a bottom wall of the housing and a securing means attached to a back wall of the housing.
Figure 5:
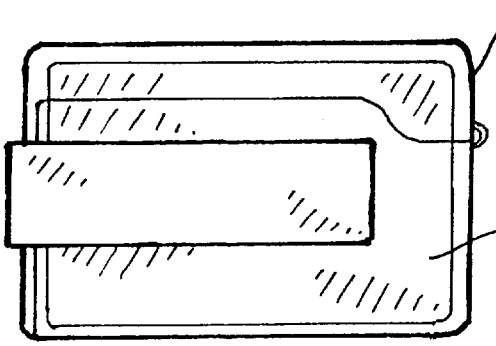
FIG. 5 is a schematic posterior view of the present invention showing the positioning of a securing means attached to a back wall of the housing.

As illustrated in FIGS. 1, 4 and 5, there is a hinge 40 coupling the cover 30 to the housing 11. The hinge 40 is mounted between the edge 34 of a second end 41 of the cover 30 and the second side wall 16 of the housing 11. The hinge 40 may comprise a substantially rigid material such as, for example, a metal or a plastic.

To reduce the chances of the housing 11 being lost, a securing means 42 for securing the housing 11 to an article of clothing may be provided. The securing means 42 comprises a clip that has a first end 44 and a second end 45. The first end 44 of the clip is coupled to the back wall 13 of the housing 11 and positioned generally adjacent to the first side wall 15. The second end 45 of the clip is positioned generally adjacent to the second side wall 16 of the housing 11. The clip may have a width of approximately three-quarters of an inch and a length measuring approximately one and one-half inches.

A display 46 is mounted on the front wall 12 of the housing 11, and extends generally between the first and second side walls 15 and 16 of the housing 11 and positioned in the raised surface 18 of the housing 11. In one embodiment, the display 46 may exhibit a fixed time indicia marked at the time of manufacture. The predetermined time indicia may be marked by a sticker adhered to the front wall 12 of the housing.

In another embodiment, a functional clock 47 may be mounted in the housing 11. The display 46 would exhibit a time output of the clock 47. To increase the resemblance of the housing 11 to a pager, the display 46 may include a digital display of numeric characters. The display 46 may have a generally oblong shape. However, the display may have other shapes such as, for example, a generally rectangular or oval shape.

A power supply 50 may be provided for powering the clock 47, and may be removably mounted in the bottom wall 14 of the housing 11. The power supply 50 is electrically connected to the clock 47. The power supply 50 may comprise a battery. Due to the size of the housing 11, the power supply 50 may preferably be a watch battery.

There is a plurality of buttons 52 mounted on the housing 11, and the buttons 52 utilized for setting the clock 47 mounted on the housing 11. Each of the buttons 52 may be substantially flush with an outer surface 53 of the front wall 12. Each of the buttons 52 is positioned generally between the display 46 and the shoulder 20. For an embodiment lacking a clock, each of the buttons 52 would be non-functional and possibly molded into the front wall 12 of the housing 11.

A pill box insert 60 for storing and organizing pills in the housing 11 may be removably insertable in the storage compartment 17 of the housing 11. The pill box insert 60 includes a front wall 62 and a back wall 64. A bottom wall 65 and a pair of lateral side walls 66 is coupled to and extending between the front and back walls 62 and 64 of the pill box insert 60. A first intermediate wall 67 is coupled to and extending between each of the lateral side walls 66. A plurality of second intermediate walls 68 is coupled to and extending between the front and back walls 62 and 64 of the pill box insert 60 and the first intermediate wall 67. Each of the second intermediate walls 68 is spaced apart. In an embodiment, a plurality of compartments 70 is defined. The first and second intermediate walls 67 and 68 may be arranged to define a variety of various size compartments 70. Additionally, the pill box insert 60 may be used to store and organize items other than pills such as, for example, money, eye care products, or business cards.

In use, the housing 11 may be used with or without the pill box insert 60 depending upon the amount of room needed. Once items are placed into the housing 11, the cover is placed in its closed position securing the items in the housing 11. The housing 11 may then be secured to an article of clothing by a securing means 42.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A storage container resembling a pager, said container comprising:

a housing having a front wall and a back wall, a bottom wall and a first side wall and a second side wall being coupled to and extending between said front and back walls to define a storage compartment having an open top, wherein an interior of said storage compartment extends substantially an entire length and width of an exterior of said housing;

an insert for storing and organizing items in a discrete and disguised manner, said insert being removably inserted in said storage compartment of said housing, an exterior of said insert being dimensionally equivalent to said interior of said storage compartment such that said insert occupies substantially all of said housing;

a cover being pivotally coupled to said housing for selectively covering said open top such that said cover is positionable between an open position and a closed position, said cover having a first end and a second end;

a display being mounted on said front wall of said housing; and a plurality of buttons being mounted on said front wall of said housing;

wherein said housing has a shoulder being formed on said front wall, said shoulder extending generally from said second side wall toward said first side wall to define a raised surface between said shoulder and said bottom wall, said display being mounted in said raised surface such that said display does not protrude into said storage compartment of said housing, a peripheral wall of said cover having a free edge, said free edge selectively abutting a ridge of said shoulder when said cover is in said closed position such that said open top of said housing is substantially covered.

2. The storage container of claim 1, wherein said front and back walls of said housing extend beyond said first side wall such that a channel is defined, a protruding member being attached to an outer surface of said first side wall and extending between an inner surface of said front and back walls, an inner surface of said first end of said cover having a recess extending therein, said recess having a size adapted for releasably engaging said protruding member.

3. The storage container of claim 1, wherein said cover has a top wall and a peripheral wall being coupled to and extending downwardly away from said top wall such that a cavity is defined, a portion of said front, back and said first side wall of said housing being positioned in said cavity when said cover is in said closed position.

4. The storage container of claim 1, wherein said first end of said cover selectively engages said front, back and first side wall of said housing when in said closed position, said first end of said cover having a length extending beyond a length of a peripheral wall of said cover.

5. The storage container of claim 1, additionally comprising a hinge coupling said cover to said housing, said hinge being mounted between a bottom edge of said second end of said cover and a top edge of said second side wall of said housing.

6. The storage container of claim 1, additionally comprising a securing means for securing said housing to an article of clothing.

7. The storage container of claim 6, wherein said securing means comprises a clip having a first end and a second end, said first end of said clip being coupled to said back wall of said housing.

8. The storage container of claim 1, additionally comprising a clock being mounted adjacent to said display in said raised surface of said housing, and wherein said display displays a time output of said clock.

9. The storage container of claim 8, wherein said buttons are adapted to setting a current time of said clock.

10. The storage container of claim 8, additionally comprising a power supply for powering said clock, said power supply being removably mounted to an outer surface of said bottom wall of said housing such that said power supply does not protrude into said storage compartment of said housing, said power supply being electrically connected to said clock.

11. The storage container of claim 1, wherein said insert has a front wall and a back wall, a bottom wall and a pair of lateral side walls being coupled to and extending between said front and back walls of said insert, a first intermediate wall being coupled to and extending between each of said lateral side walls, a plurality of second intermediate walls being coupled to and extending between said front and back walls of said insert and said intermediate wall, each of said second intermediate walls being spaced apart, wherein a plurality of compartments are defined.

12. A storage container resembling a pager, said container comprising:

a housing having a front wall and a back wall, a bottom wall and a first side wall and a second side wall being coupled to and extending between said front and back walls to define a storage compartment having an open top, an interior of said storage compartment extending substantially an entire length and width of an exterior said housing, a shoulder being formed on said front wall, said shoulder extending generally from said second side wall toward said first side wall to define a raised surface between said shoulder and said bottom wall, wherein said front wall has a ridge, said front and back walls extending beyond said first side wall such that a channel is defined, a protruding member being attached to an outer surface of said first side wall and extending between an inner surface of said front and back walls, said protruding member being positioned generally between said open top and said bottom wall, said housing comprising a substantially rigid material;

a cover being pivotally coupled to said housing for selectively covering said open top, said cover being positionable between an open and a closed position, said cover having a top wall, a peripheral wall being coupled to and extending downwardly away from said top wall such that a cavity is defined, said front, back and each of said side walls of said housing being removably positionable in said cavity when said cover is in said closed position, said peripheral wall having a pair of free edges, each of said free edges being orientated generally parallel to said front and back walls of said housing, a first end of said cover selectively engaging said front, back and first side wall of said housing, said first end of said cover having a length extending beyond a length of said peripheral wall of said cover, an inner surface of said first end of said cover having a recess extending therein, said recess being positioned generally adjacent to and extending between each of said free edges of said peripheral wall, said recess having a size adapted for releasably engaging said protruding member of said first end wall of said housing, said free edge of said housing selectively abutting said shoulder of said front wall when said cover is in said closed position;

a hinge for hingedly coupling said cover to said housing, said hinge being mounted between said edge of a second end of said cover and said second side wall of said housing;

a securing means for securing said housing to an article of clothing, said securing means comprising a clip having a first end and a second end, said first end of said clip being coupled to said back wall of said housing and positioned generally adjacent to said first side wall, said second end of said clip being positioned generally adjacent to said second side wall of said housing;

a display being mounted on said front wall of said housing and in said raised surface of said housing, said display having a generally oblong shape extending generally between said first and second side walls of said housing;

a clock being mounted in said display, wherein said display displays a time output of said clock, said clock being positioned generally adjacent to said bottom wall of said housing, said clock having a digital display;

a power supply for powering said clock, said power supply being removably mounted in said bottom wall of said housing, said power supply being electrically connected to said digital clock, said power supply comprising a battery;

a plurality of buttons for setting said clock, each of said buttons being mounted on said front wall of said housing, each of said buttons being substantially flush with an outer surface of said front wall, each of said buttons being positioned generally between said display of said clock and said shoulder; and a pill box insert for storing and organizing pills in a discrete and disguised manner in said housing, said pill box insert being removably inserted in said storage compartment of said housing, an exterior of said insert being dimensionally equivalent to said interior of said storage compartment such that said insert occupies substantially all of said housing, said pill box insert having a front wall and a back wall, a bottom wall and a pair of lateral side walls being coupled to and extending between said front and back walls of said pill box insert, a first intermediate wall being coupled to and extending between each of said lateral side walls, a plurality of second intermediate walls being coupled to and extending between said front and back walls of said pill box insert and said intermediate wall, each of said second intermediate walls being spaced apart, wherein a plurality of compartments are defined.

* * * * *